United States Patent [19]

Kahrs

[11] Patent Number: 4,659,297

[45] Date of Patent: Apr. 21, 1987

[54] VARIABLE CAPACITY VANE MOTOR HAVING ROTATABLE AND STATIONARY CAM RINGS

[75] Inventor: Manfred Kahrs, Wiesbaden, Fed. Rep. of Germany

[73] Assignee: Alfred Teves GmbH, Frankfurt am Main, Fed. Rep. of Germany

[21] Appl. No.: 805,345

[22] Filed: Dec. 4, 1985

[30] Foreign Application Priority Data

Dec. 5, 1984 [DE] Fed. Rep. of Germany ..... 3444262

[51] Int. Cl.[4] ..... F01C 1/344; F01C 21/14; F03C 2/00

[52] U.S. Cl. ..... 418/22; 418/25; 418/27; 418/210; 418/215

[58] Field of Search ..... 418/16, 22, 24–27, 418/210, 215; 417/218, 220

[56] References Cited

U.S. PATENT DOCUMENTS

| | | | |
|---|---|---|---|
| 3,016,017 | 1/1962 | Prendergast | 418/22 |
| 3,153,384 | 10/1964 | Castle, Jr. et al. | 418/22 |
| 3,455,245 | 7/1969 | Reichling | 418/77 |
| 4,406,599 | 9/1983 | Stephan | 418/22 |
| 4,445,830 | 5/1984 | Woodruff | 418/22 |

FOREIGN PATENT DOCUMENTS

| | | | |
|---|---|---|---|
| 1209036 | 9/1959 | France | 418/22 |
| 567845 | 10/1977 | U.S.S.R. | 418/16 |

*Primary Examiner*—John J. Vrablik

*Attorney, Agent, or Firm*—James B. Raden; Donald J. Breh

[57] ABSTRACT

A vane motor is disclosed in which the volumetric displacement, torque, or speed are continuously adjustable. The vane motor includes a housing having a rotor and cam ring disposed axially around the rotor. The rotor includes vanes in radial slots which divide the motor between the rotor and cam rings. One cam ring is rotatable relative to the other so as to change volumetric displacement.

8 Claims, 3 Drawing Figures

VARIABLE CAPACITY VANE MOTOR HAVING ROTATABLE AND STATIONARY CAM RINGS

BACKGROUND OF THE INVENTION

The present invention relates to a vane motor of the type including a rotor arranged in a housing and several cam rings disposed axially in side-by-side relation surrounding the rotor and having sets of vanes associated with one of the cam rings respectively, the vanes being slidable in radially extending slots in the rotor and dividing a working chamber located between the rotor and the cam rings and provided with inlet and outlet ports into and out from the working cells. The side plates laterally confine the working chamber.

A vane motor of this type is disclosed in the U.S. Pat. No. 3,455,245. That vane motor includes a housing wherein there are arranged axially in side-by-side relation two vane assemblies, each including of a cam ring, vanes, and a rotor element which are arranged between two side plates. The cam rings are of equal track and are disposed in axial alignment relative to their track. Bolts and dowels extending through the two cam rings prevent relative rotation of the cam rings and the two side plates. In a vane motor of such construction, the volumetric displacement of the motor can only be changed in steps by changing the number of vane assemblies arranged axially adjacent to each other.

Also, in the magazine "Olhydraulik und Pneumatik" 19 (1975) no. 3, pages 153 et sqq., a continuously adjustable double-action vane pump having only one cam ring which is rotatable relative to inlet and outlet ports for the purpose of changing the volumetric displacement is described.

Since this type of arrangement provides unfavorable flow conditions which may lead to high pressure pulsations, extensive measures are required to compensate for the detrimental effects on this pump.

SUMMARY OF THE INVENTION

The present invention provides a vane motor of the type referred to hereinabove which is of simple construction and in which the volumetric displacement of the motor and thus, the torque or speed thereof are continuously adjustable and in which pulsations of the pressure medium and/or of the output torque are minimized.

According to a preferred aspect of the present invention, there is provided at least one cam ring that is rotatable in a circumferential direction relative to a second cam ring.

According to an important feature of the invention, there is provided two cam rings, one of which is nonrotatable. As compared to a vane-type machine having only one rotatable cam ring, this feature has the important advantage that the momentary displacement of fluid against the normal flow direction that occurs due to the action of the rotating cam ring is substantially compensated by the cam ring which is fixed in its normal position. Pressure pulsations and resulting torque variations and noises are thereby minimized.

According to a very important aspect of the invention, there is provided a vane motor of particularly simple construction and including an inlet and an outlet port in one of the side plates. And another particularly advantageous feature provides for the rotatable cam ring arranged adjacent to the side plate containing the inlet and outlet ports, since this has the effect of largely minimizing the flow paths of the pressure medium flowing in and out of the working cells.

According to another important feature of the invention, the thickness of the nonrotatable cam ring is less than the thickness of the rotatable cam ring providing for a smaller angle of relative rotation of the rotatable cam ring. Thus, the radial displacement of the vanes takes place subject to substantially balanced pressure and thus, without transverse load.

It is particularly advantageous that the thickness selected for the nonrotatable cam ring correspond to approximately one-half the thickness of the rotatable cam ring.

According to a still further important aspect of the invention, it is advantageous that the rotor include sections connected together in a way preventing relative rotation. Advantageously, the number of sections corresponds to the number of cam rings and have a thickness substantially corresponding to the thickness of the associated cam ring. Further, the connected sections have slots aligned with each other for accepting the vanes.

A still further feature of the invention provides for the rotatable cam ring to be arranged in the housing in a smooth-running manner by supporting the rotatable cam ring with bearing members disposed around its periphery.

According to another very important feature of the invention, a rotating device is arranged in a substantially tangential relation to the circumference of the cam ring.

A further important aspect provides for the rotating device to include a fluid pressure responsive control piston and which engages the cam ring between bearing points. This structure enables the motor to be controlled in a simple manner by means of a control pressure or automatically.

Advantageously, there is provided a joint between the control piston and the cam ring; or alternatively, there can be provided matching involute surfaces.

BRIEF DESCRIPTION OF THE DRAWINGS

The invention will be better understood after a reading of the Detailed Description in conjunction with the accompanying drawings of which.

DETAILED DESCRIPTION

Figure 1:
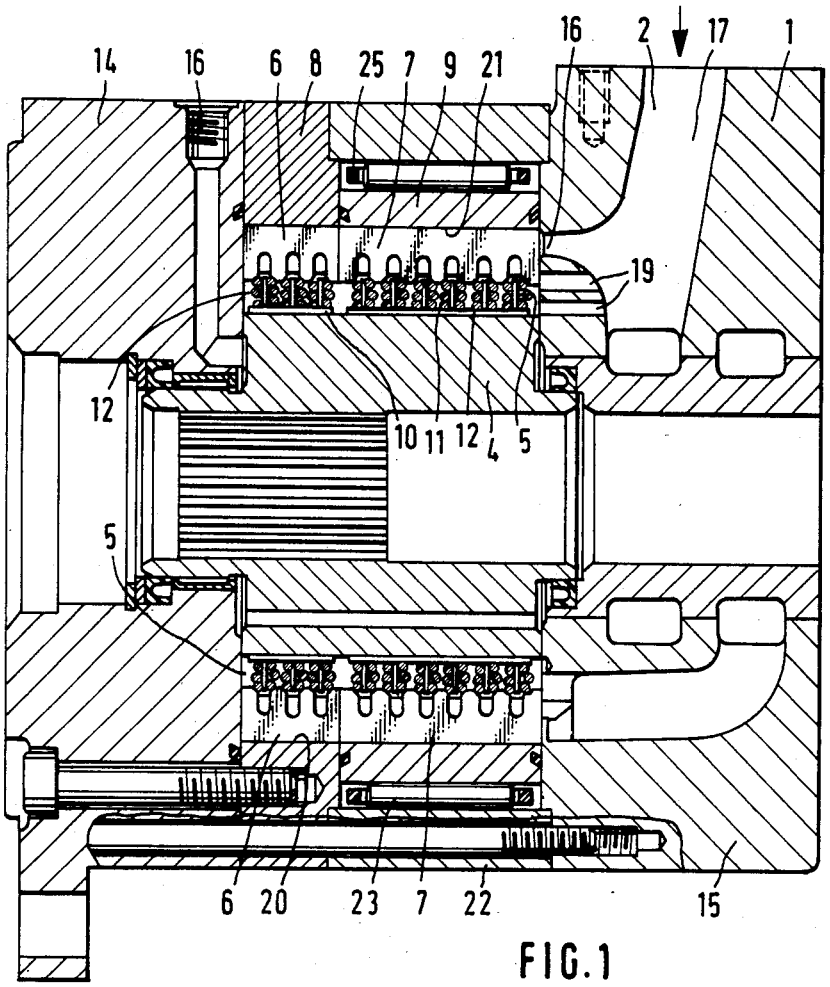
FIG. 1 is a longitudinal section of a vane motor according to the invention showing details of construction.

The vane-type machine according to the invention includes a housing 1 including several components having a connection 2 for a pressure medium supply and a further connection, not shown, for drainage of the pressure medium. Inside the vane-type machine there is a rotor 4 connected, in a manner preventing relative rotation, to a shaft for transmission of torque. The rotor has radial slots 5 in each of which two vanes 6, 7 are slidably arranged. The vanes 6 can abut to a cam ring 8, whereas the vanes 7 can abut to a cam ring 9. Abutment of the vanes 6, 7 is supported by vane extending springs 12 guided by spring guides 10, 11. The springs are arranged in bottom bores of the slots 5.

Between the cam rings 8, 9 and the rotor surface area, a working chamber is formed which is divided into working cells 13 by the vanes 6, 7. The working chamber is confined in an axial direction by housing components in the form of side plates 14, 15.

The side plate 14 has a bore 16 for recirculating the oil that leaks through the running clearance between the rotor 4 and the side plates 14, 15.

The side plate 15 contains a passage 17 leading from the connection 2 to inlet ports 16, as well as a passage leading from the outlet ports 18 to the connection for drainage of the pressure medium. The inlet and outlet ports 16, 18 are reniform and are formed in the surface of the side plate 15 facing the working chamber. The number of inlet ports 16 and outlet ports 18 corresponds to the number of cam tracks 20, 21 formed at the cam rings 8, 9 respectively. For the purposes of supporting the abutment of the vanes in certain phases, the side plate 15 further contains passages 19 for pressure medium supply to the bottom bores of the slots 5.

The cam rings 8, 9 arranged between the side plates 14 and 15 are provided with gaskets at axial abutment surfaces. The cam ring 8 is firmly screwed to the side plate 14. Between the cam ring 8 and the side plate 15, an intermediate ring 22 surrounding the cam ring 9 is disposed. The side plate 14, the cam ring 8, the intermediate ring 22, and the side plate 15 are firmly connected with one another and form the housing 1 of the vane motor.

The cam ring 9 is arranged between the cam ring 8 and the side plate 15 so as to have some play, and is radially supported at the intermediate ring 22 by a roller bearing 23 or a side bearing (not shown) so that it is rotatable in a circumferential direction.

Bearing of the cam ring 9 in the intermediate ring 22 is not assured along the entire periphery, but rather at, for example, five bearing points 24 equally distributed around the periphery. The rollers are kept at a predetermined distance by, for example, a cage 25.

Figure 3:
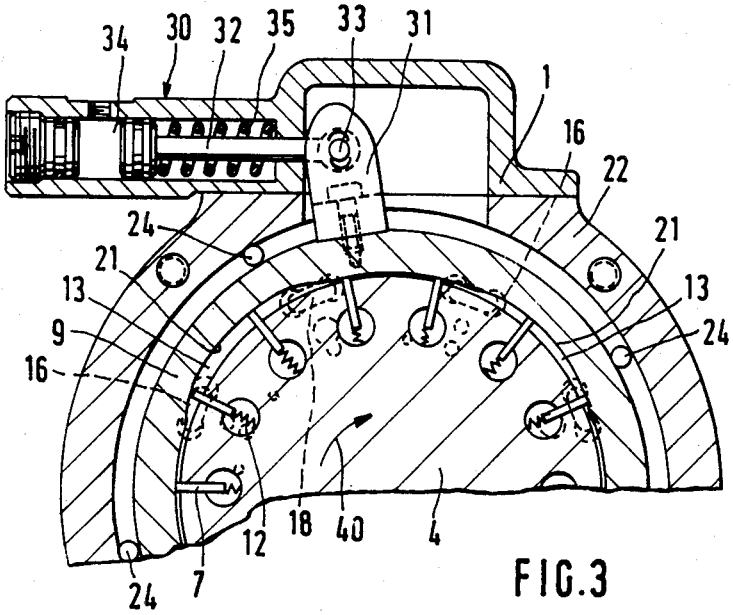
FIG. 3 is a cross-section of the vane motor according to FIG. 1 taken in the plane of the rotatable cam ring showing details of construction.

As becomes apparent from FIG. 3, a rotating device 30 is disposed in a substantially tangential relation to the cam ring 9 and engages the cam ring 9 by way of a forked intermediate member 31 through an opening in the cage 25. The legs of the intermediate member 31 include long holes in which a bolt 33 connected with a control piston 32 is slidably guided. The control piston 32 is disposed in a pressure medium chamber 34 and is displaceable by means of a control pressure. Since in the embodiment shown the motor rotates only in one direction, the control piston has only one pressurizable surface for displacement against the moment of reaction. Between the control piston 32 and the housing 1, there is arranged a readjusting spring 35 which urges the cam ring 9 against the rotating direction of the rotor 4 and maintains it against the abutment shown at the left-hand side in FIG. 3, when the motor is unpressurized.

Figure 2:
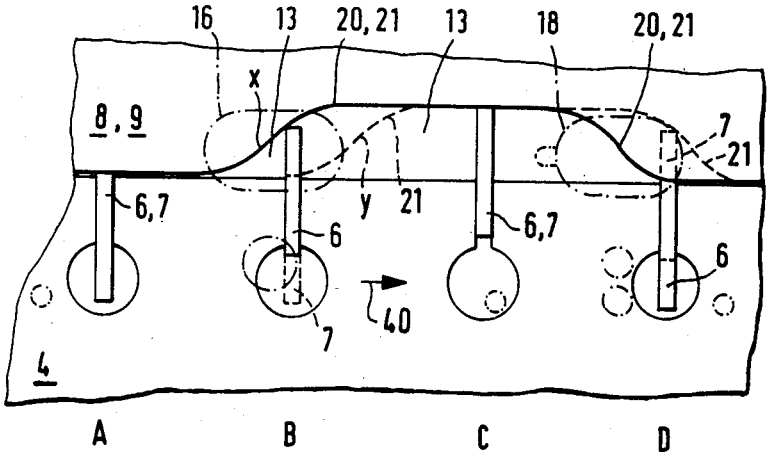
FIG. 2 is a diagrammatic, developed view of cam tracks.

The mode of operation of the vane motor according to the present invention is described hereinafter, reference being had to FIG. 2:

FIG. 2 shows the vane extending conditions during the course of a rotation of the rotor 4. The vanes 6 and 7, shown behind one another, take up the positions marked by the letters A to D when the rotor 4 rotates in the direction marked by the arrow 40. The cam rings 8, 9 and the rotor 4 are shown in a developed view. The solid line X indicates the position of the cam track 20 of the nonrotatable cam ring 8, and the position of the cam track 21 of the cam ring 9 when not rotated relative to the cam ring 8 and relative to an inlet port 16 and an outlet port 18. The broken line Y indicates the course of the cam track 21 when the cam ring 9 has rotated relative to the nonrotatable cam ring 8.

First, the situation shall be considered where the cam tracks 20, 21 of both cam rings 8, 9 are in axial alignment with the cam tracks 20, 21 of both cam rings 8. 9 being identical in the described example. As shown in FIG. 2, the cam tracks 20, 21 of both cam rings 8, 9 are in their normal position characterized by the solid line X. Pressure medium subject to high pressure is fed thorugh the inlet port 16 into the working cell 13 causes a rotation of the rotor 4 in the direction marked by the arrow 40 and flows through the outlet port 18 to the connection for drainage of the depressurized pressure medium. The vanes 6, 7 slide synchronously when passing the positions A to D in the slot 5 of the rotor 4. The motor operates at maximum volumetric displacement, i.e. at minimum speed and maximum torque.

Now the situation shall be considered where, while the position of the cam track 20 of the nonrotatable cam ring 8 is unchanged, the cam track 21 adopts the position marked by the broken line Y relative to the inlet and outlet ports 16, 18. The vanes 6, 7 no longer move synchronously since the movement of the vane 6 is determined by the cam track 20 and that of the vane 7 by the cam track 21. The result is a volumetric displacement that is lower than the maximum volumetric displacement.

Not shown is the situation where the cam ring 9 is rotated to such an extent that its track 21 comes to lie in symmetrical position to the center of the inlet port 16. The result in that situation is a partial volumetric displacement determined only by the cell zone of the nonrotatable cam ring 8 since the cell zone of the rotatable cam ring 9 does not influence the volumetric displacement due to the continuous connection with the inlet port 16.

If both cam rings 8, 9 are made to be rotatable relative to the inlet and outlet ports 16, 18 and to each other in such a way that both cam tracks come to lie in a symmetrical position over the inlet and outlet ports, it can be achieved as a result no effective volumetric displacement and thus, no torque.

What is claimed is:

1. A vane motor comprising:

a rotor arranged in a housing;

two cam rings disposed in side-by-side relation surrounding the rotor, one of said two cam rings being non-rotatable and the second of said two cam rings being rotatable relative to said one cam ring;

a plurality of vanes associated with each one of the two cam rings respectively, said vanes being slidable in radially extending slots in the rotor and define at least one working chamber located between the rotor and the cam rings;

two opposing side plates one adjacent the non-rotatable cam ring and one adjacent the rotatable cam ring laterally confining the at least one working chamber, said side plate adjacent said rotatable cam ring including an inlet port and an outlet port into said at least one working chamber; and a rotating device arranged in substantially tangential relationship to the circumference of the rotatable cam ring engaging said rotatable cam ring.

2. The vane motor as defined in claim 1, wherein the nonrotatable cam ring has a thickness less than the thickness of the rotatable cam ring.

3. The vane motor as defined in claim 2, wherein the thickness of the nonrotatable cam ring is approximately one-half the thickness of the rotatable cam ring.

4. The vane motor as defined in claim 1, wherein the rotor includes two sections connected with each other in nonrotatable relation, the sections each having a thickness corresponding substantially to that of an associated one of said two cam rings and said connected sections each including slots substantially in alignment with each other.

5. The vane motor as defined in claim 1, wherein the one rotatable cam ring is supported by a plurality of equally spaced apart bearing members arranged along the circumference of said one rotatable cam ring.

6. The vane motor as defined in claim 1, wherein the rotating device includes a fluid pressure responsive control piston engaging the rotatable cam ring.

7. The vane motor as defined in claim 6, wherein a joint is provided between the control piston and the cam ring.

8. Vane motor as defined in claim 1, wherein the cam rings include means providing for different lengths of stroke of said vanes and include cam tracks having different lengths.

* * * * *